US012193505B2

(12) United States Patent
Liu

(10) Patent No.: US 12,193,505 B2
(45) Date of Patent: Jan. 14, 2025

(54) ATOMIZATION CUP, SMOKE GUIDING CUP, AND ATOMIZER ASSEMBLY

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 507 days.

(21) Appl. No.: 17/364,793

(22) Filed: Jun. 30, 2021

(65) Prior Publication Data

US 2022/0304388 A1 Sep. 29, 2022

(30) Foreign Application Priority Data

Mar. 23, 2021 (CN) ..... 202110310907.8
Mar. 23, 2021 (CN) ..... 202120592272.0
May 16, 2021 (CN) ..... 202110531215.6
May 16, 2021 (CN) ..... 202121038999.0

(51) Int. Cl.
*A24F 40/465* (2020.01)
*A24F 40/42* (2020.01)

(52) U.S. Cl.
CPC ..... *A24F 40/465* (2020.01); *A24F 40/42* (2020.01)

(58) Field of Classification Search
CPC ..... A24F 1/30; A24F 5/00; A24F 7/00
See application file for complete search history.

(56) References Cited

U.S. PATENT DOCUMENTS

2014/0326257 A1* 11/2014 Jalloul ..... A24F 1/30
2017/0025178 A1* 1/2017 Armoush ..... A24F 1/30
2021/0059297 A1* 3/2021 Fernando ..... A24F 1/30
2023/0380484 A1* 11/2023 Khachatryan ..... A24F 1/30

FOREIGN PATENT DOCUMENTS

CN 207236100 U * 4/2018 ..... A24F 47/00

* cited by examiner

*Primary Examiner* — Christopher M Rodd
*Assistant Examiner* — Daniel Edward Vakili
(74) *Attorney, Agent, or Firm* — MATTHIAS SCHOLL P.C.; Matthias Scholl

(57) ABSTRACT

An atomization cup including a cup body. The cup body includes a cavity and at least one through hole. The cavity is configured to accommodate a tobacco material. The smoke or vapor generated by the tobacco material escapes from the cup body via the at least one through hole. The at least one through hole communicates with the cavity. The cup body further includes a side wall. The side wall includes a heating element made of conductive material, or the side wall is made of conductive material.

12 Claims, 16 Drawing Sheets

ATOMIZATION CUP, SMOKE GUIDING CUP, AND ATOMIZER ASSEMBLY

CROSS-REFERENCE TO RELATED APPLICATIONS

Pursuant to 35 U.S.C. § 119 and the Paris Convention Treaty, this application claims foreign priority to Chinese Patent Application No. 202110310907.8 filed Mar. 23, 2021, to Chinese Patent Application No. 202120592272.0 filed Mar. 23, 2021, to Chinese Patent Application No. 202110531215.6 filed May 16, 2021, and to Chinese Patent Application No. 202121038999.0 filed May 16, 2021. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to the field of electronic cigarettes, and more particularly, to an atomization cup, a smoke guiding cup, and an atomizer assembly of an electronic cigarette.

E-cigarette atomizes tobacco materials to generate smoke/vapor for users to inhale. Tobacco materials refer to tobacco tar, tobacco paste, tobacco leaf and other materials used to produce smoke. At present, e-cigarettes work through atomization of e-liquid or heat tobacco materials. However, conventional electronic cigarettes contain no parts that can accommodate tobacco material and heat it at the same time.

SUMMARY

One object of the disclosure is to provide an atomization cup comprising a cup body. The cup body comprises a cavity and a through hole. The cavity is configured to accommodate a tobacco material; smoke or vapor generated from the tobacco material escapes from the cup body via the at least one through hole; the at least one through hole communicates with the cavity; the cup body further comprises a side wall; the side wall comprises a heating element made of conductive material, or the side wall is made of conductive material.

The cup body comprises a side wall comprising an inner surface and an outer surface. A heating element is disposed on the inner and/or outer surface, or disposed inside the side wall. The side wall is at least partially coated with the heating element.

When the side wall comprises the heating element made of conductive material, the side wall comprises a thermally conductive material, such as glass, agate, quartz, crystal, jade, mica, or ceramic, etc. The heating element is disposed on the inner surface of the side wall to prevent direct contact between the tobacco materials and cup body while the tobacco materials are still heated due to the thermal conductivity of the side wall.

In a class of this embodiment, the cup body further comprises an opening; the tobacco material is put in or taken out of the cup body via the opening; and the opening communicates with the cavity.

In a class of this embodiment, a bottom wall is disposed on one end of the side wall and is opposite to the opening. The side wall and the bottom wall are connected to each other to form the cavity.

In a class of this embodiment, the atomization cup further comprises a first flange disposed on the side wall, and the first flange protrudes outward in a circumferential direction of the side wall.

The side wall further comprises a first surrounding portion and a second surrounding portion. The second surrounding portion is connected to the first surrounding portion and the bottom wall. The first flange is disposed on one end of the first rounded portion away from the second surrounding portion. The heating element is disposed inside the second surrounding portion.

In a class of this embodiment, the atomization cup further comprises a second flange. The first surrounding portion comprises a first surrounding section, a second surrounding section, and a third surrounding section. The second surrounding section is connected to the first surrounding section and the third surrounding section. The first flange protrudes from the outer peripheral surface of the first surrounding section. The third surrounding section is connected to the second surrounding section. The second flange is disposed on the second surrounding section, and protrudes outward in a circumferential direction of the second surrounding section.

The outer diameter of the second flange is smaller than that of the first flange. The first flange and the second flange form a step.

In a class of this embodiment, the through hole is disposed on the bottom wall and/or the side wall.

In a class of this embodiment, the through hole is disposed on the bottom wall. The atomization cup further comprises a guide tube disposed on one side of the bottom wall away from the cavity. The guide tube further comprises a first channel connected to the through hole.

In a class of this embodiment, the atomization cup comprises at least one through hole.

In a class of this embodiment, the side wall is in the shape of a cylinder, a three-sided prism, or a square column.

In a class of this embodiment, the side wall is integrated with the bottom wall.

In a class of this embodiment, the heating element made of the conductive material generates heat by electrifying or by high frequency magnetic field, and the conductive material is at least one of metal, graphene, semiconductor, superconductor and carbon-containing conductive material; and/or the side wall comprises an inner surface and an outer surface; the heating element is disposed on the inner surface and/or the outer surface, or disposed inside the side wall;

the heating element is in the shape of film, layer, net, or wire, and is disposed on the side wall in at least one manner of embedding, coating, printing, cladding and pasting; and the side wall comprises glass, agate, quartz, crystal, jade, mica, or ceramic.

Specifically, the heating element is disposed inside the side wall and/or the outer side of the side wall. When the heating element is disposed in the side wall, a passivation layer is disposed outside the heating element or the heating element is disposed away from the tobacco materials. If the tobacco materials directly contact with the metal parts of an e-cigarette, harmful substances are generated during the heating process and would cause damage to the users. In addition, the produced smoke or vapor tends to stain the inner wall of the atomization cup, and the stains on the metal materials are difficult to remove. The passivation layer is made of glass, agate, quartz, crystal, jade, mica, or ceramic.

In a class of this embodiment, the bottom wall comprises a heating element made of conductive material, or the bottom wall is made of conductive material; and/or a protective part is disposed on an inner surface and/or an outer surface of the bottom wall, and/or disposed on an inner surface and/or an outer surface of the bottom wall.

In a class of this embodiment, the protective part comprises glass, agate, quartz, crystal, jade, mica or ceramic; and/or the conductive material is at least one of metal, graphene, semiconductor, superconductor and carbon-containing conductive material; and/or the bottom wall comprises an inner surface and an outer surface; the heating element is disposed on the inner surface and/or the outer surface of the bottom wall, or disposed inside the bottom wall;

the heating element is in the shape of film, layer, net and wire, and is disposed on the bottom wall in at least one manner of embedding, coating, printing, cladding and pasting; and the bottom wall comprises glass, agate, quartz, crystal, jade, mica, or ceramic.

Specifically, the heating element is disposed inside the bottom wall and/or the outer side of the bottom wall. When the heating element is disposed in the bottom wall, a passivation layer is disposed outside the heating element or the heating element is disposed away from the tobacco materials.

The second object of the disclosure is to provide a smoke guiding cup. The smoke guiding cup comprises a support part, and a connection part connected to the support part. The support part is configured to support the atomization cup. The support part and the connection part are in the shape of a hollow tube; and the support part and the connection part are connected to each other whereby a second channel is formed to transport the smoke generated in the atomization cup.

In a class of this embodiment, the connection part comprises a first connecting section and a second connecting section. The first connecting section is connected to the support part and the second connecting section.

In a class of this embodiment, the support part is in the shape of a circular tube or a square tube; and/or the first connecting section is in the shape of a straight tube or a curved tube; and/or the second connecting section is in the shape of a curved tub; the second connecting section comprises a proximal end close to the first connecting section, and a distal end away from the first connecting section; and a diameter of the second connecting section decreases from the proximal end to the distal end.

In a class of this embodiment, a frosted layer is disposed on the outer surface of the smoke guiding cup.

The third object of the disclosure is to provide an atomizer assembly comprising the atomization cup.

In a class of this embodiment, the atomizer assembly further comprises the smoke guiding cup. The smoke guiding cup comprises a second channel; the atomization cup is detachably disposed in the smoke guiding cup, and the second channel communicates with the through hole.

In a class of this embodiment, the smoke guiding cup comprises a support part and a connection part connected to the support part. The atomization cup is encompassed by the support part. The support part and the connection part are in the shape of a hollow tube; and the support part and the connection part are connected to each other whereby the second channel is formed.

In a class of this embodiment, the connection part comprises a first connecting section and a second connecting section. The first connecting section is connected to the support part and the second connecting section.

In a class of this embodiment, the inner diameter of the support part is smaller than the outer diameter of the first flange and not smaller than the outer diameter of the second flange. The end of the support part away from the first connecting section is connected to the step.

In a class of this embodiment, a frosted layer is disposed on the outer surface of the smoke guiding cup.

The disclosure provides an atomization cup, a smoke guiding cup for supporting the atomization cup and transporting smoke, and an atomizer assembly comprising the atomization cup. The atomization cup can not only accommodate the tobacco materials (such as tobacco leaves, pastes, tobacco tar, etc.), but also can use the heating element to generate electricity or high-frequency magnetic field to generate heat, which is convenient to use. The heating element is disposed on the outer surface of the side wall or disposed inside of the side wall, or on the inner surface of the side wall away from the tobacco material. The tobacco materials are placed into the cavity of the atomization cup. When heated, the tobacco materials are not in direct contact with the heating element, eliminating the generation of harmful substances. The smoke generated does not stain on the metal part of the atomization cup, facilitating the cleaning thereof.

Figure 1:
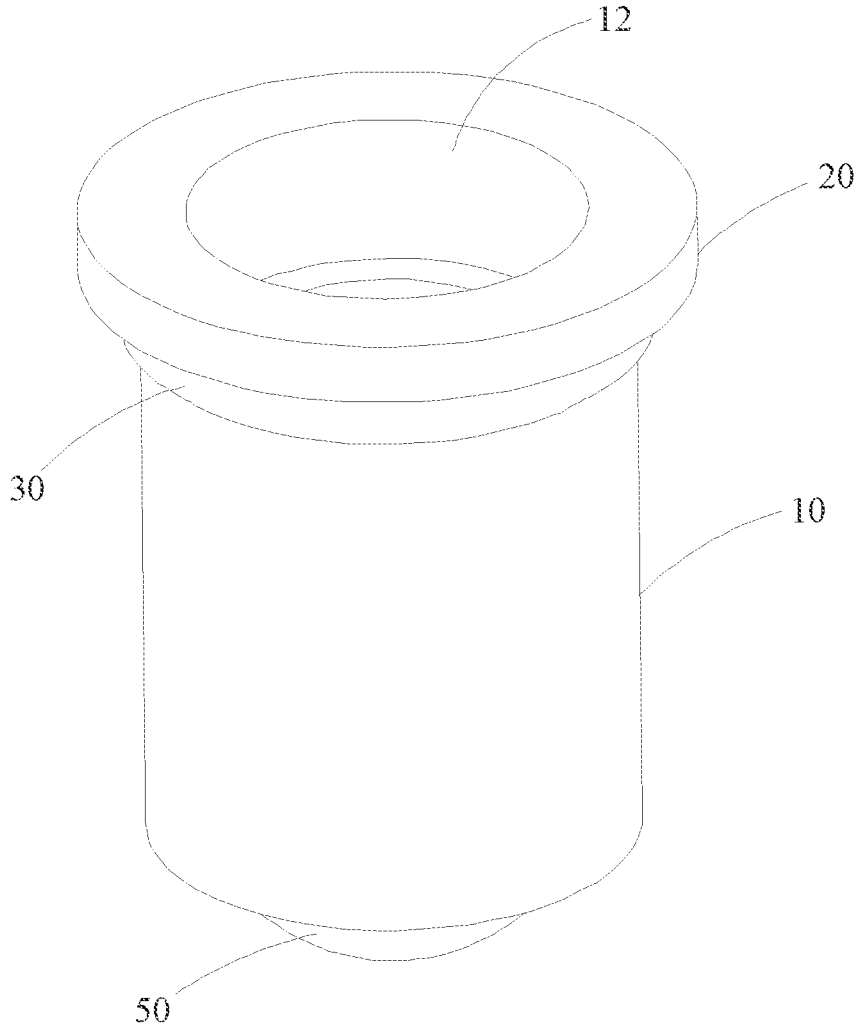
FIG. 1 is a schematic diagram of an atomization cup according to Example 1 of the disclosure.

In the drawings, the following reference numbers are used: 1. Atomization cup; 10. Cup body; 11. Cavity; 12. Opening; 13. Through hole; 14. Side wall; 141. First surrounding portion; 1411. First surrounding section; 1412.

Second surrounding section; 1413. Third surrounding section; 142. Second surrounding portion; 15. Bottom wall; 16. Heating element; 20. First flange; 21. Second channel; 22. Support part; 23. Connection part; 231. First connecting section; 232. Second connecting section; 24. Frosted layer; 100. Atomizer assembly; 200. Smoke filter; and 300. High-frequency induction heater.

DETAILED DESCRIPTION

To further illustrate the disclosure, embodiments detailing an atomization cup, a smoke guiding cup, and an atomizer assembly are described below. It should be noted that the following embodiments are intended to describe and not to limit the disclosure.

Example 1

Figure 2:
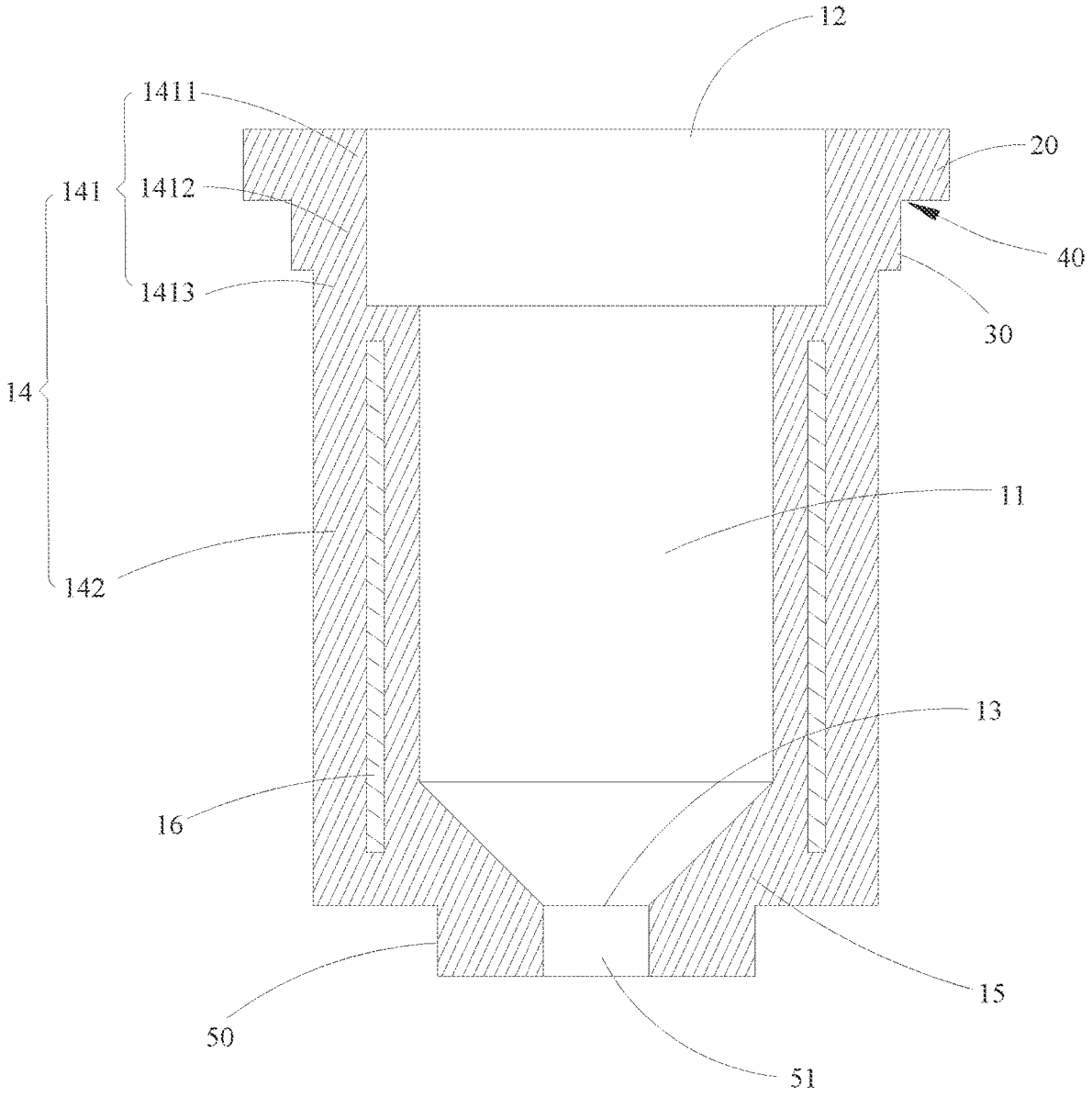
FIG. 2 is a cross-sectional view of an atomization cup according to Example 1 of the disclosure.

Referring to FIGS. 1-2, an atomization cup 1 comprising a cup body 10. The cup body 10 comprises a cavity 11, an opening 12, and a through hole 13. The cavity 11 is configured to accommodate tobacco materials. The opening 12 allows passage of the tobacco materials into and out of the atomization cup 1. The smoke generated escapes from the cup body 1 via the through hole 13. Both the through hole 13 and the opening 12 communicate with the cavity 11.

The cup body 10 comprises a side wall 14 comprising an inner surface and an outer surface. A heating element 16 is disposed inside the side wall 14. Alternatively, the heating element 16 is disposed on the outer surface of the side wall 14. Alternatively, the heating element 16 is disposed inside the side wall 14 and disposed on the outer surface of the side wall 14. Or, the heating element 16 is disposed in the inner layer of the side wall, or the side wall 14 is made of conductive material.

The tobacco materials (such as tobacco tar, tobacco paste, etc.) are placed into the cavity 11 through the opening 12, or the heated tobacco materials are taken out from the cavity 11 through the opening 12. The smoke generated escapes from the cup body 1 via the through hole 13 and is inhaled through the user's mouth. The heating element 16, which is disposed inside the side wall 14, is induction-heated to burn the tobacco materials. Referring to FIGS. 1, 2, 8, and 10, the atomization cup 1 is disposed in a smoke guiding cup 2 and the smoke guiding cup 2 is connected to a smoke filter 200. A high-frequency induction heater 300 is disposed on the outer circumference of the atomizing cup 1. The high-frequency induction heater 300 comprises an induction coil wrapping around the heating element 16. The high-frequency induction heater 300 is energized, producing an alternating current that flows through the induction coil to produce an alternating magnetic field. An eddy current is induced in the heating element 16 by the alternating magnetic field and is used to heat the heating element 16. The heated heating element 16 heats the tobacco materials in the cavity 11. The external air inhaled through the opening 12 drives the generated smoke to flow via the through hole 13 and the smoke guiding cup 2 into the smoke filter 200 for inhalation. The smoke filter 200 and the high-frequency heater 300 are consistent with conventional structures, and accordingly not described further herein. In this example, the heating element 16 is disposed inside the side wall 14, but not on the inner surface of the atomization cup 1. When heated, the tobacco materials in the cavity are therefore not in direct contact with the metal materials, eliminating the generation of harmful substances. The smoke generated does not stain on the metal part of atomization cup 1, which makes cleaning easy.

Referring to FIGS. 1 and 2, the atomization cup 1 further comprises a first flange 20 protruding outward in the circumferential direction of the side wall 14. The first flange 20 facilitates installation of the atomization cup 1.

Referring to FIGS. 1 and 2, a bottom wall 15 is disposed on one end of the side wall 14 and is opposite to the opening 12. The side wall 14 and the bottom wall 15 are connected to each other to form the cavity 11. In certain embodiments, the bottom wall 15 is not provided.

Figure 8:
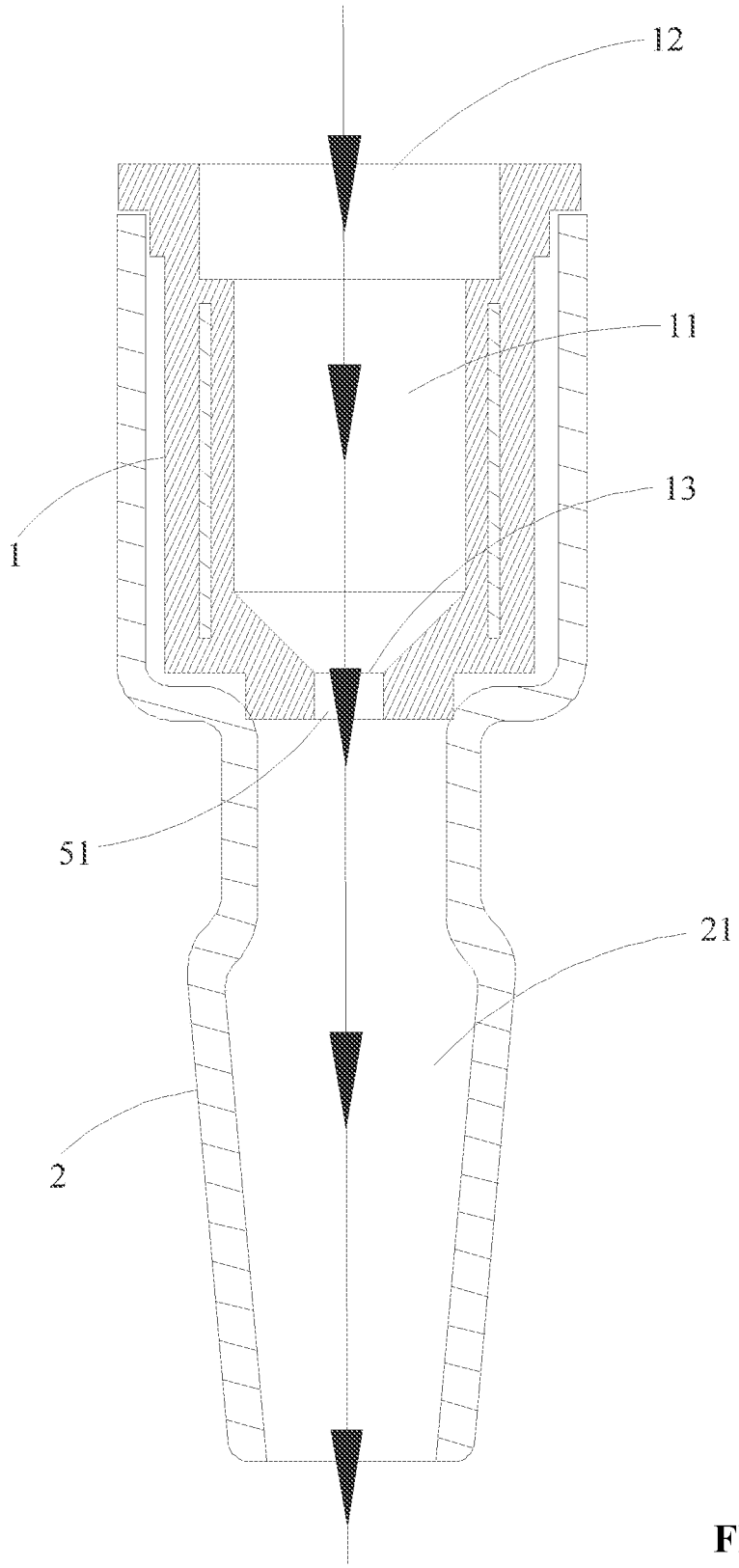
FIG. 8 indicates direction to which the air flows in the first atomizer assembly according to Example 1 of the disclosure.

Referring to FIGS. 2 and 8, the side wall 14 further comprises a first surrounding portion 141 and a second surrounding portion 142. The second surrounding portion 142 is connected to the first surrounding portion 141 and the bottom wall 15. The first flange 20 is disposed on one end of the first surrounding portion 141 that is away from the second surrounding portion 142. The heating element 16 is disposed inside the second surrounding portion 142. The atomization cup 1 is inserted into the smoke guiding cup 2 and supported by the first flange 20, preventing the atomization cup 1 detaching from the smoke guiding cup 2.

Referring to FIGS. 1, 2 and 8, the atomization cup 1 further comprises a second flange 30. The first surrounding portion 141 comprises a first surrounding section 1411, a second surrounding section 1412, and a third surrounding section 1413. The second surrounding section 1412 is connected to the first surrounding section 1411 and the third surrounding section 1413. The first flange 20 protrudes from the outer peripheral surface of the first surrounding section 1411. The second flange 30 protrudes outward in the circumferential direction of the second surrounding section 1412. The outer diameter of the second flange 30 is smaller than that of the first flange 20. The first flange 20 and the second flange 30 form a step 40, providing a stable installation site for the atomization cup 1 disposed in the smoke guiding cup 2. In certain embodiments, the second flange 30 is not provided, or comprises a plurality of protrusions spaced apart from each other and disposed along the second surrounding section 1412. In certain embodiments, the third surrounding section 1413 is not provided. In certain embodiments, the through hole 13 goes through the bottom wall 15.

Referring to FIGS. 1 and 2, the atomization cup 1 further comprises a guide tube 50 disposed on one side of the bottom wall 15 that is away from the cavity 11. The guide tube 50 further comprises a first channel 51 connected to the through hole 13. The smoke generated flows from the through hole 13, through the guide tube 50, to the user's mouth, preventing the smoke release.

In certain embodiments, the atomization cup 1 comprises at least one through hole 13. Optionally, a plurality of through holes is practicable.

In certain embodiments, the side wall 14 is in the shape of a cylinder, a three-sided prism, or a square column. Optionally, other shapes of the side wall are practicable.

In certain embodiments, the side wall 14 is integrated with the bottom wall 15, which is convenient for processing and assembling of the atomization cup 1.

In certain embodiments, the side wall 14 and the bottom wall 15 comprise glass, agate, quartz, crystal, jade, or mica, on which the smoke generated is not easy to stain, making easy cleaning.

Figure 3:
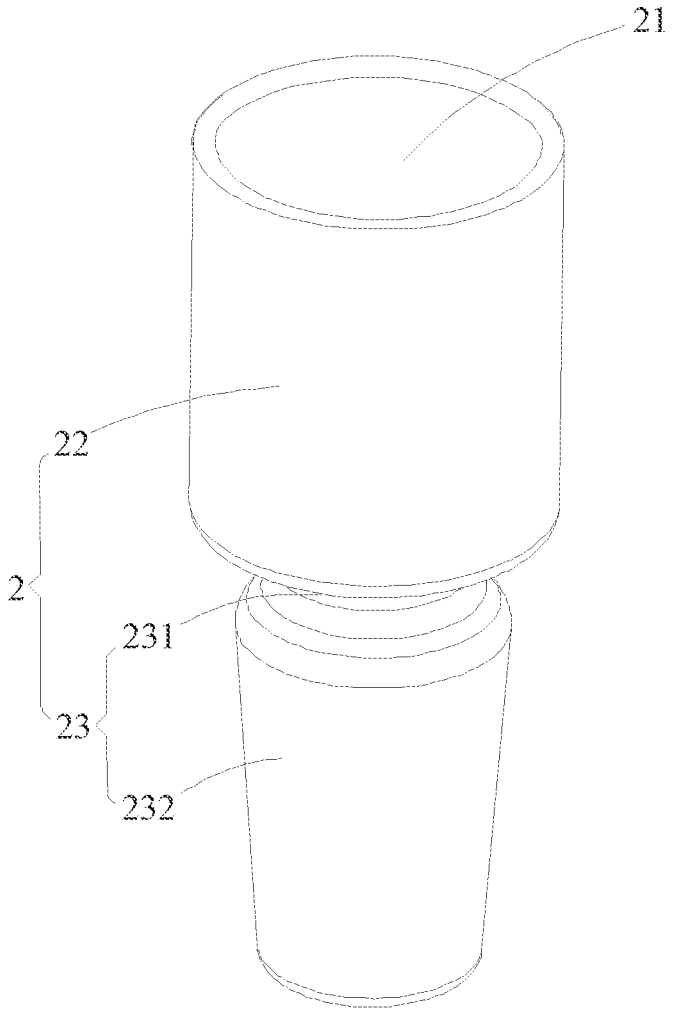
FIG. 3 is a schematic diagram of a smoke guiding cup according to Example 1 of the disclosure.
Figure 9:
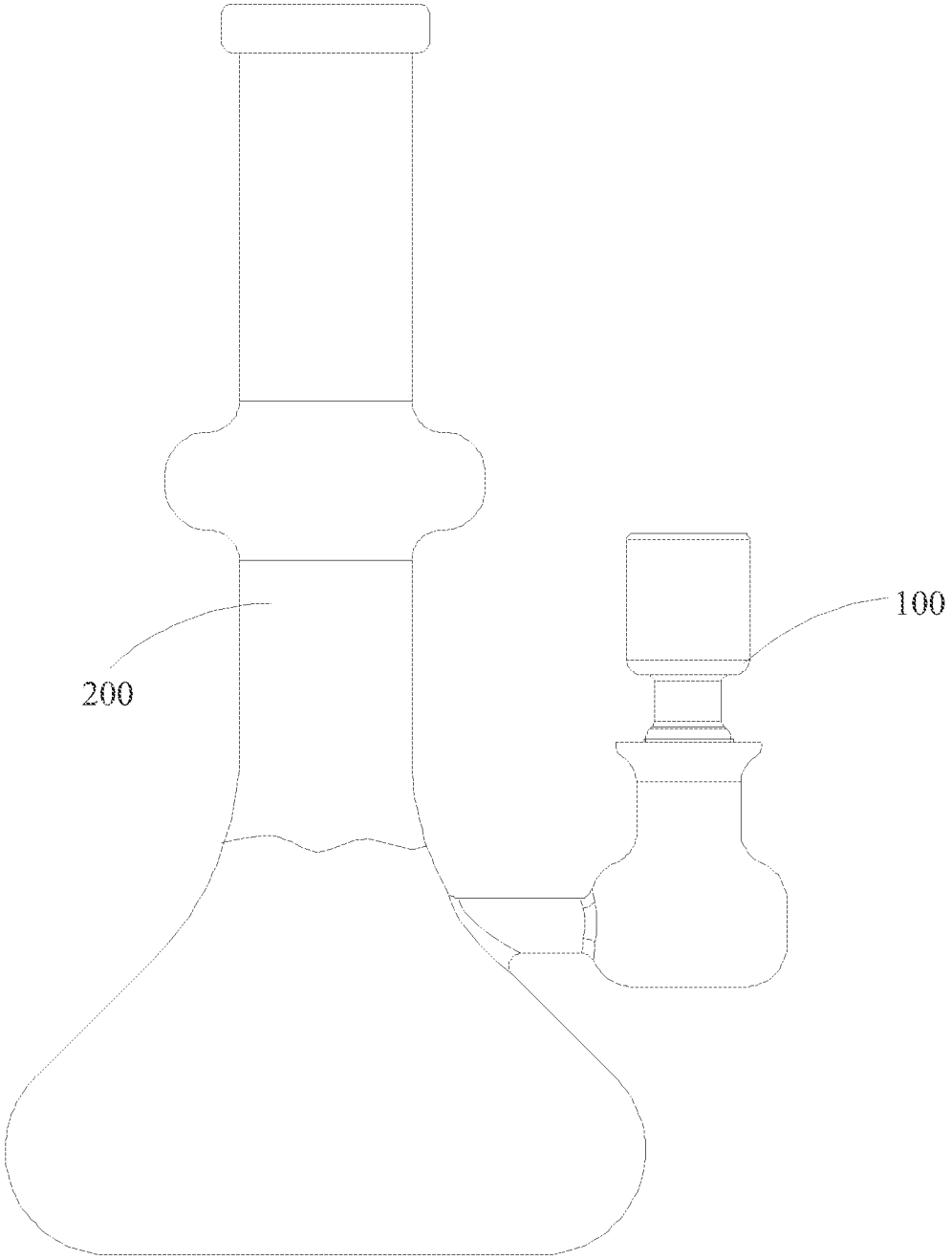
FIG. 9 schematic diagram that shows the atomizer assembly integrated with the smoke filter according to Example 1 of the disclosure.

Referring to FIGS. 3, 8, and 9, a smoke guiding cup 2 comprises a support part 22, and a connection part 23 connected to the support part 22. The support part 22 is configured to support the atomization cup 1. The support part 22 and the connection part 23 are in the shape of a hollow tube and connected together to form a second channel 21 for transporting the smoke generated. The connection part 23 is connected to the smoke filter 200, so that the smoke generated flows from the through hole 13, through the second channel 21, to the smoke filter 200.

Referring to FIG. 3, the connection part 23 comprises a first connecting section 231 and a second connecting section 232. The first connecting section 231 is connected to the support part 22 and the second connecting section 232. In certain embodiments, the first connecting section 231 is not provided.

Figure 4:
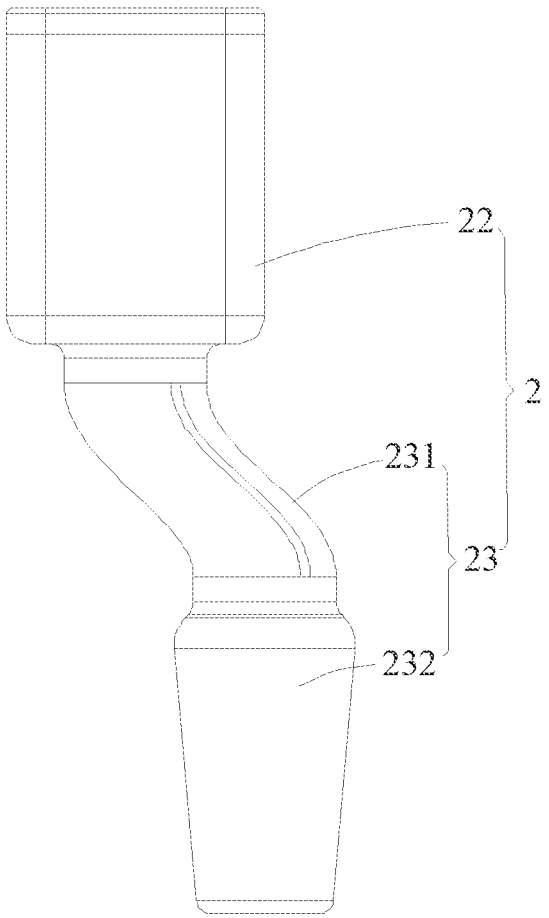
FIG. 4 is a schematic diagram of another smoke guiding cup according to Example 1 of the disclosure.

Referring to FIGS. 3 and 4, the support part 22 is in the shape of a circular tube or a square tube. Optionally, other shapes of the support part are practicable.

Referring to FIGS. 3 and 4, the first connecting section 231 is in the shape of a straight tube or a curved tube. Optionally, other shapes of the first connecting section are practicable.

Referring to FIGS. 3 and 4, the second connecting section 232 is in the shape of a curved tub. The second connecting section 232 comprises a proximal end close to the first connecting section 231, and a distal end away from the first connecting section 231. The diameter of the second connecting section 232 decreases from the proximal end to the distal end so as to facilitate the arrangement of the second connecting section on the smoke filter 200.

Figure 5:
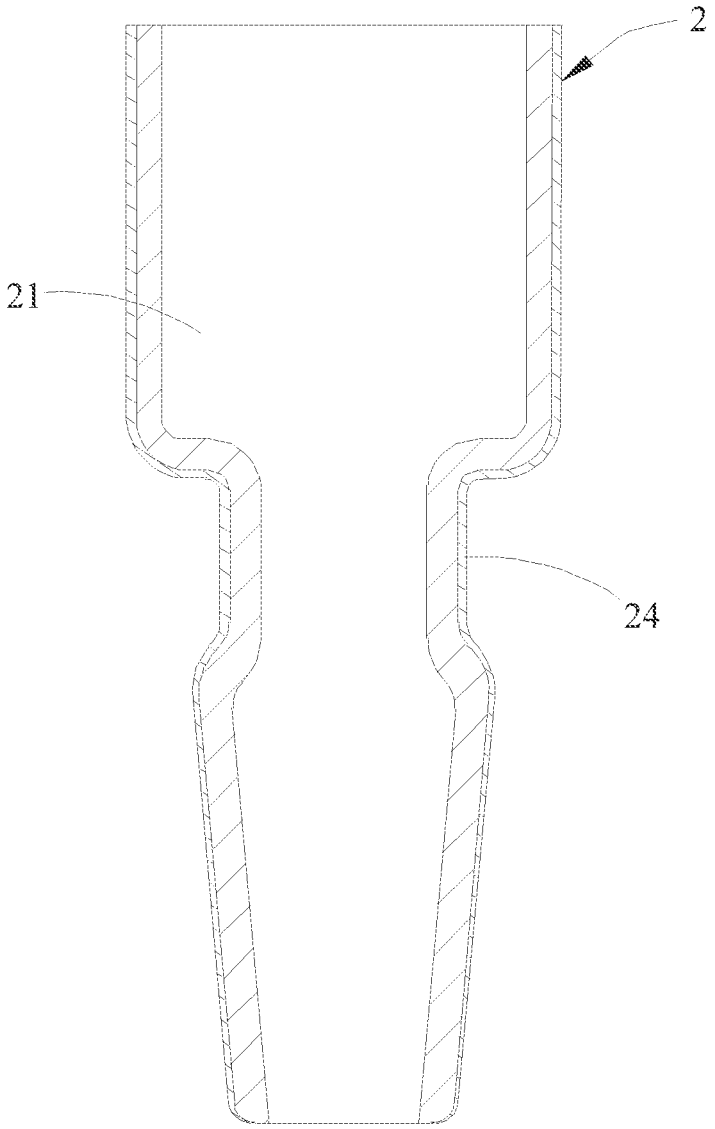
FIG. 5 is a cross-sectional view of a smoke guiding cup according to Example 1 of the disclosure.

Referring to FIG. 5, in certain embodiments, a frosted layer 24 is disposed on the outer surface of the smoke guiding cup 2 so as to increase aesthetic appeal. In certain embodiments, the frosted layer 24 is not provided.

Figure 6:
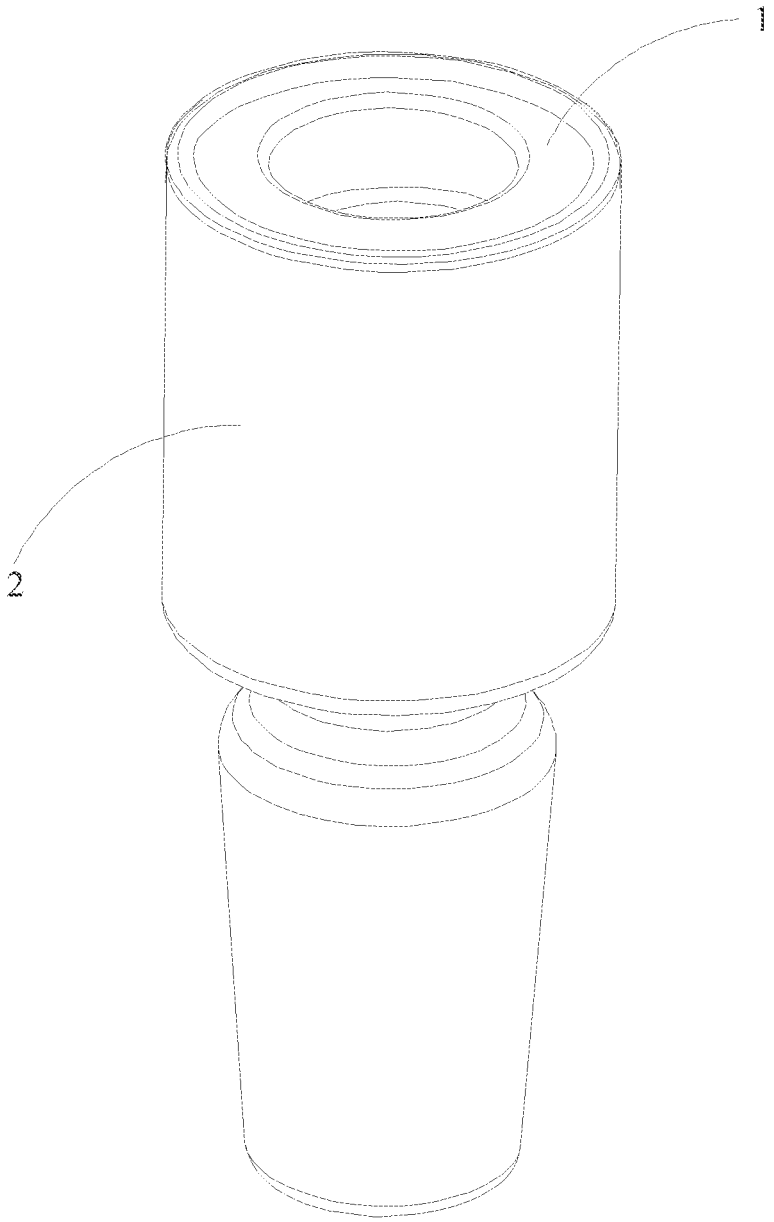
FIG. 6 is a schematic diagram of a first atomizer assembly according to Example 1 of the disclosure.
Figure 7:
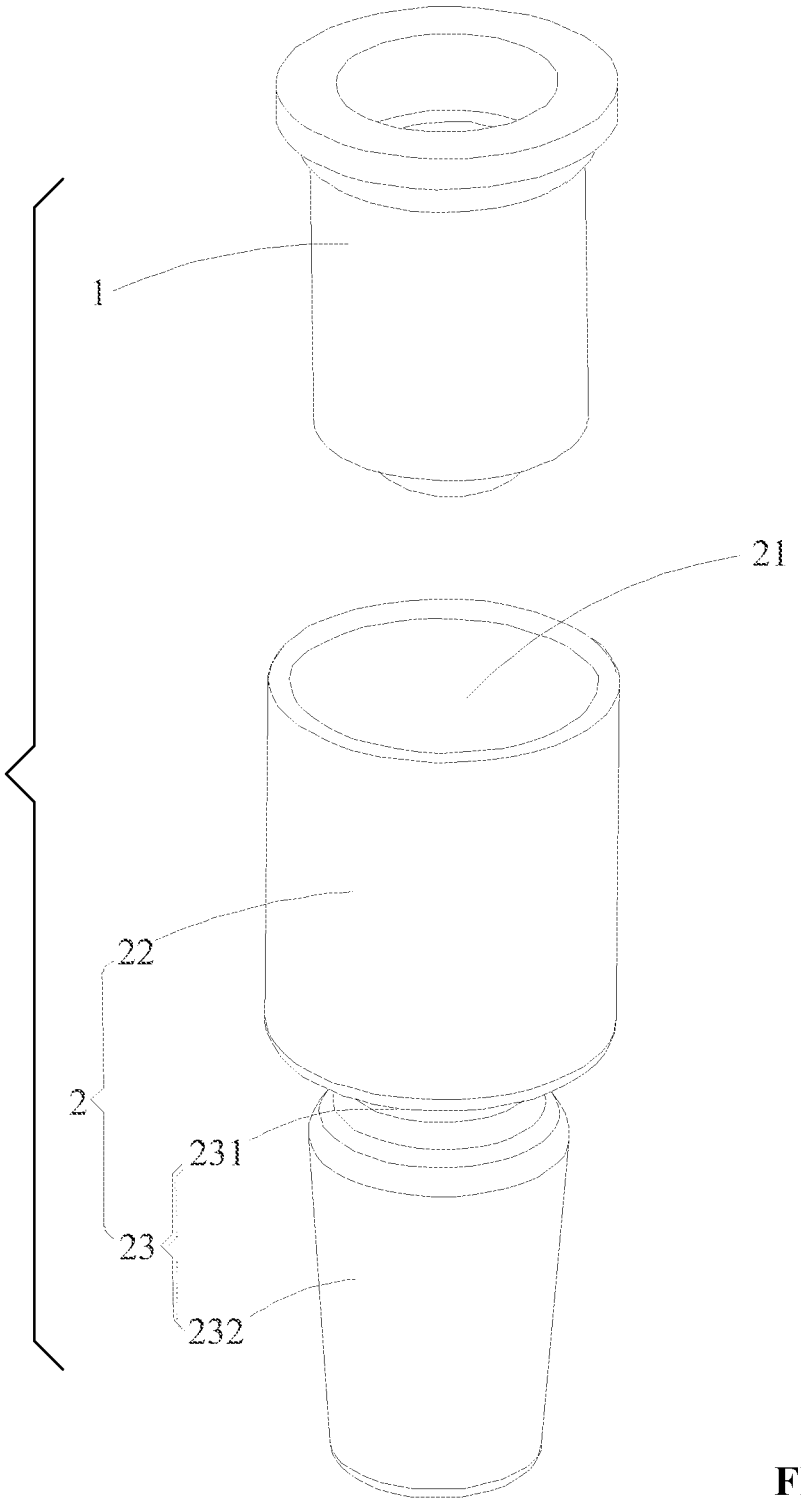
FIG. 7 is an exploded view of a first atomizer assembly according to Example 1 of the disclosure.
Figure 10:
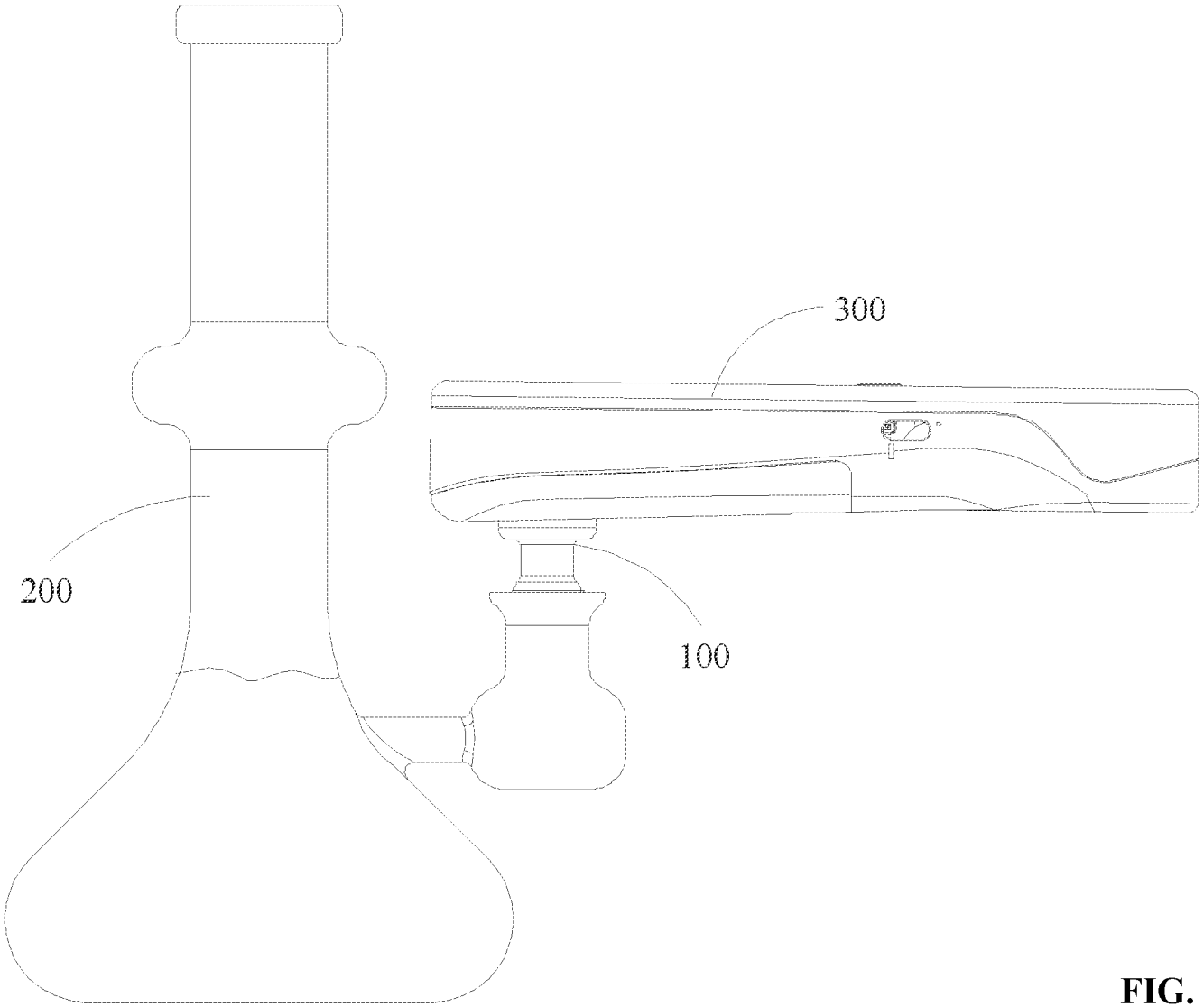
FIG. 10 is a schematic diagram that shows the atomizer assembly integrated with the smoke filter and the high-frequency heater according to Example 1 of the disclosure.
Figure 11:
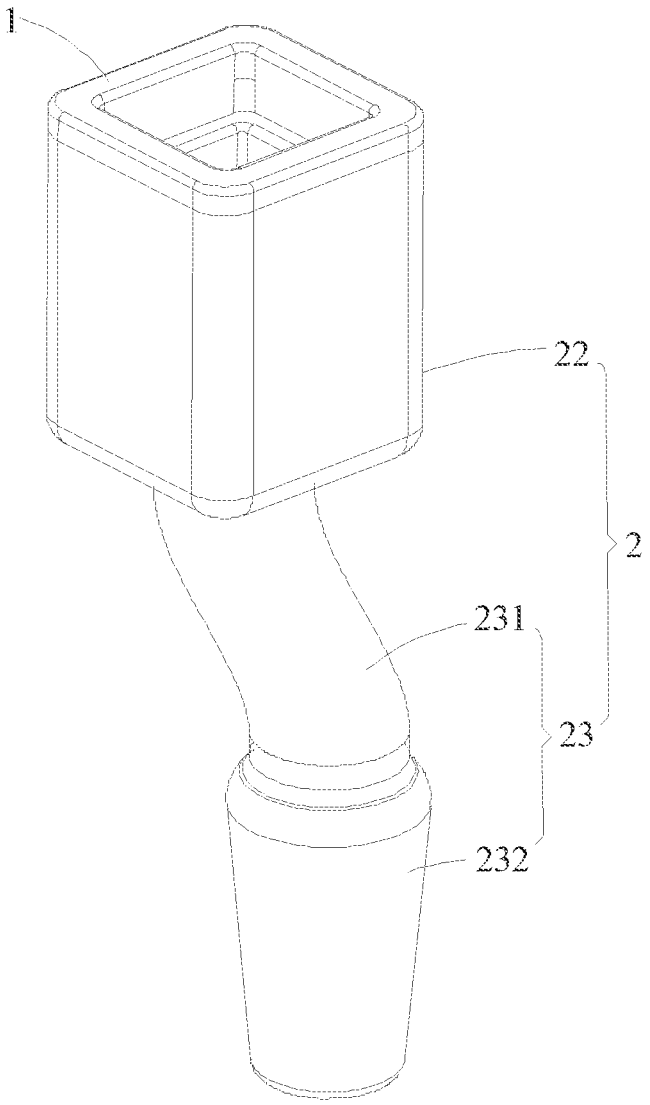
FIG. 11 is a schematic diagram of a second atomizer assembly according to Example 1 of the disclosure.
Figure 12:
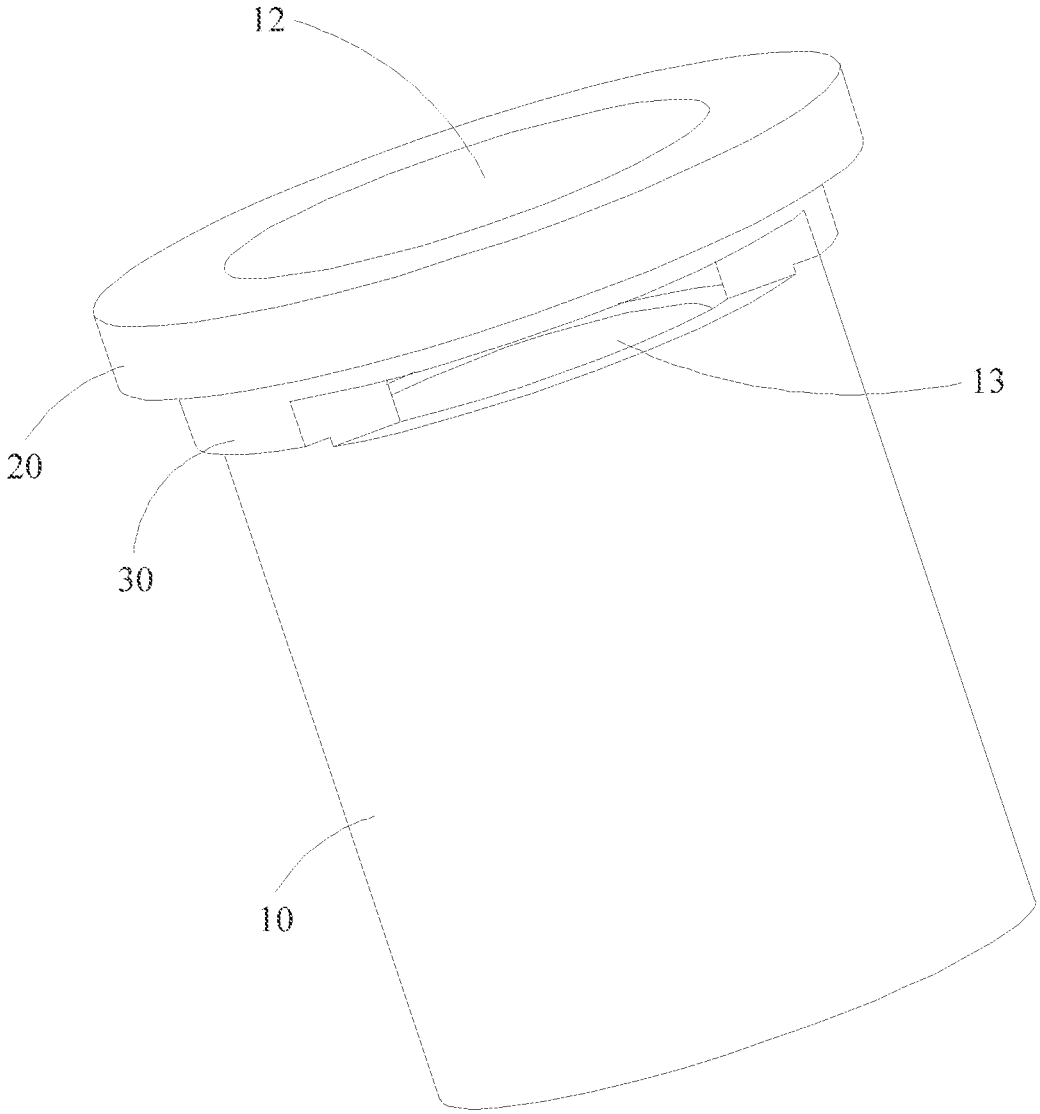
FIG. 12 is a schematic diagram of an atomization cup according to Example 2 of the disclosure.
Figure 13:
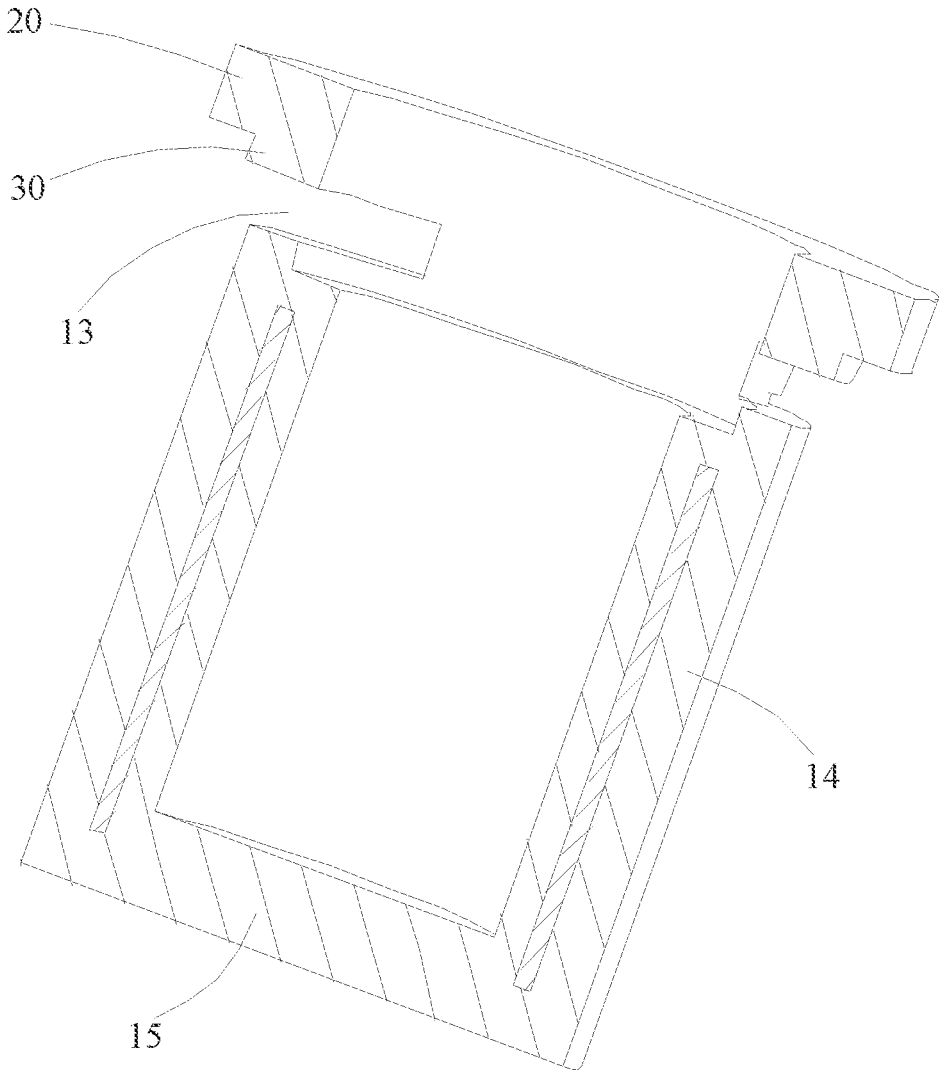
FIG. 13 is a cross-sectional view of an atomization cup according to Example 2 of the disclosure.
Figure 14:
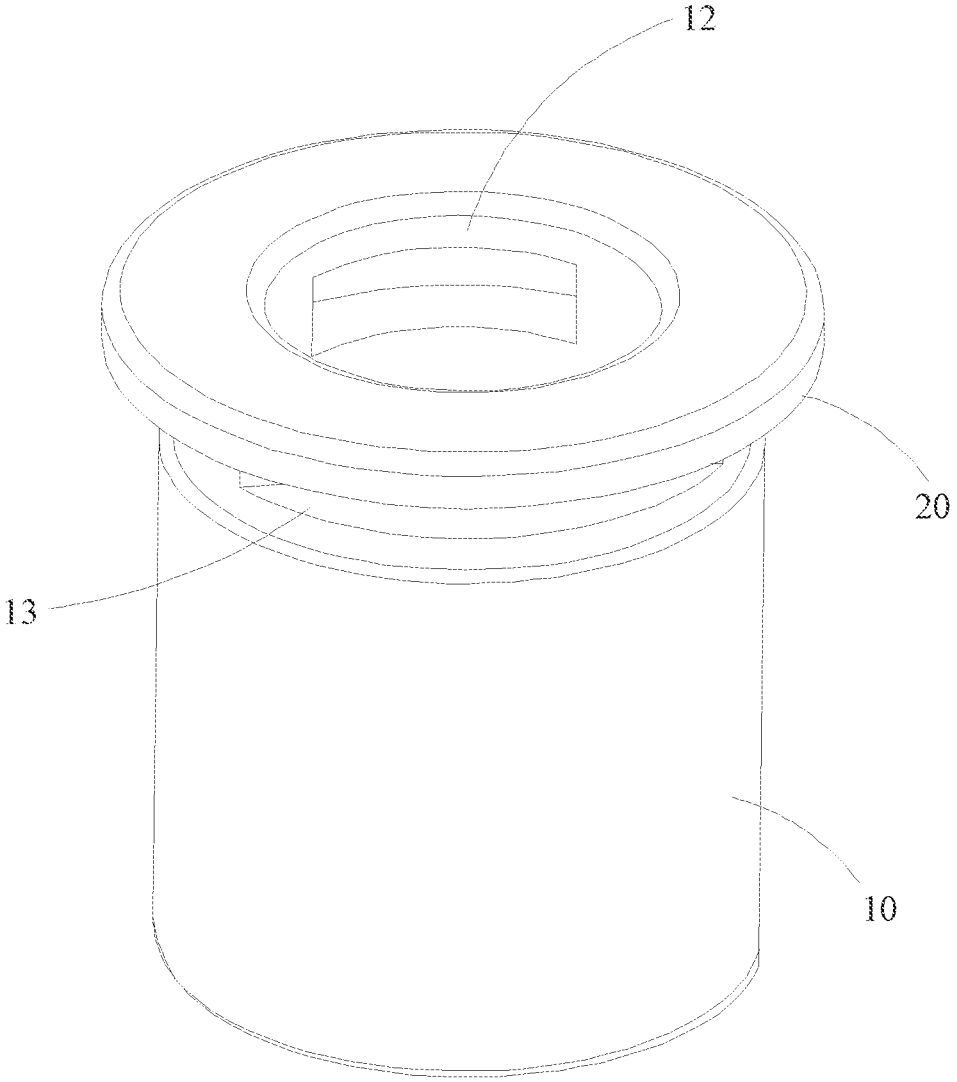
FIG. 14 is a schematic diagram of an atomization cup according to Example 3 of the disclosure.

Referring to FIGS. 6-8, an atomizer assembly 100 comprises the atomization cup 1 and the smoke guiding cup 2. The atomization cup 1 is detachably disposed in the smoke guiding cup 2, so that the second channel 21 communicates with the through hole 13. The atomizer assembly 100 is detachable, which is convenient to assemble, disassemble, and get out the stains on the atomization cup 1 and the smoke guiding cup 2. The outer surface of the guide tube 50 abuts against the inner surface of the smoke guiding cup 2, or a gap formed therebetween. Referring to FIGS. 8-10, the atomizer assembly 100 is connected to the smoke filter 200 and the high-frequency induction heater 300 is disposed on the outer circumference of the atomization cup 1. When the tobacco materials are heated to produce smoke, the external air inhaled through the opening 12 drives the smoke generated to flow via the through hole 13 and the second channel 21 into the smoke filter 200 for inhalation. FIG. 8 indicates direction to which the air flows in the atomizer assembly 100. FIG. 9 is a schematic diagram that shows the atomizer assembly 100 integrated with the smoke filter 200. FIG. 10 is a schematic diagram that shows the atomizer assembly 100 integrated with the smoke filter 200 and the high-frequency induction heater 300.

Referring to FIG. 7, the smoke guiding cup 2 comprises a support part 22, and a connection part 23 connected to the support part 22. The atomization cup 1 is encompassed by the support part 22. The support part 22 and the connection part 23 are in the shape of a hollow tube and connected together to form a second channel 21 for transporting the smoke generated.

In certain embodiments, the connection part 23 comprises a first connecting section 231 and a second connecting section 232. The first connecting section 231 is connected to the support part 22 and the second connecting section 232. In certain embodiments, the first connecting section 231 is not provided.

The first connecting section 231 is in the shape of a straight tube or a curved tube. Optionally, other shapes of the first connecting section are practicable.

The support part 22 is in the shape of a circular tube or a square tube. Optionally, other shapes of the support part are practicable.

In this example, the second connecting section 232 comprises a proximal end close to the first connecting section 231, and a distal end away from the first connecting section 231. The diameter of the second connecting section 232 decreases from the proximal end to the distal end so as to facilitate the arrangement of the second connecting section on the smoke filter 200.

Referring to FIGS. 2, 7 and 8, the inner diameter of the support part 22 is smaller than the outer diameter of the first flange 20 and not smaller than the outer diameter of the second flange 30. The end of the support part 22 that is away from the first connecting section 231 is connected to the step 40, providing a stable installation site for the atomization cup 1 disposed in the smoke guiding cup 2.

Referring to FIG. 5, in certain embodiments, a frosted layer 24 is disposed on the outer surface of the smoke guiding cup 2 so as to increase aesthetic appeal. In certain embodiments, the frosted layer 24 is not provided.

In certain embodiments, the smoke guiding cup 2 comprises ceramic, agate, quartz, crystal, or jade, so as to increase aesthetic appeal.

Example 2

Referring to FIGS. 1, 2, 12 and 13, the Example is basically the same as Example 1, except that the through hole 13 is disposed on the side wall 14 instead of on the bottom wall 15.

A plurality of through holes 13 is disposed on the second surrounding section 1412, the second flange 30, and the third surrounding section 1413. In certain embodiments, the plurality of through holes 13 are disposed on the second surrounding section 1412 and the second flange 30, or disposed on the second surrounding section 1412 or the third surrounding section 1413. The guide tube 50 is no longer needed when the through holes 13 is disposed on the side wall 14. When the atomization cup 1 is inserted into the smoke guiding cup 2, a gap is formed between the outer surface of the cup body 10 and the inner surface of the smoke guiding cup 2 so as to allow the air escaping from the through hole 13 to travel in the second channel 21 and into the smoke filter 200.

The other components in this example are the same as those of Example 1, and are therefore not described in further detail herein.

Example 3

Referring to FIGS. 1, 2, 14 and 15, this example is basically the same as Example 1, except for two differences. One difference is that the second flange 30 is disposed on the atomization cup 1 in Example 1 but not on that in Example 3. The second difference is that the through hole 13 is disposed on the side wall 14 in Example 3 instead of on the bottom wall 15 in Example 1.

The through hole 13 is disposed in a portion of the first surrounding portion 141 where the first flange 20 is not provided. In this example, the atomization cup comprises a first through hole 13, and a second through hole 13 spaced apart from the first through hole 13. In certain embodiments, the number of the through holes 13 may be one, three or four.

The guide tube 50 is no longer needed when the through holes 13 is disposed on the side wall 14. In this example, the first flange 20 is connected to the support part 22, so that the atomization cup 1 is disposed in the smoke guiding cup 2. A gap is formed between the outer surface of the cup body 10 and the inner surface of the smoke guiding cup 2 so as to allow the air escaping from the through hole 13 to travel in the second channel 21 and into the smoke filter 200.

The other components in this example are the same as those of Example 1, and are therefore not described in further detail herein.

Example 4

Figure 15:
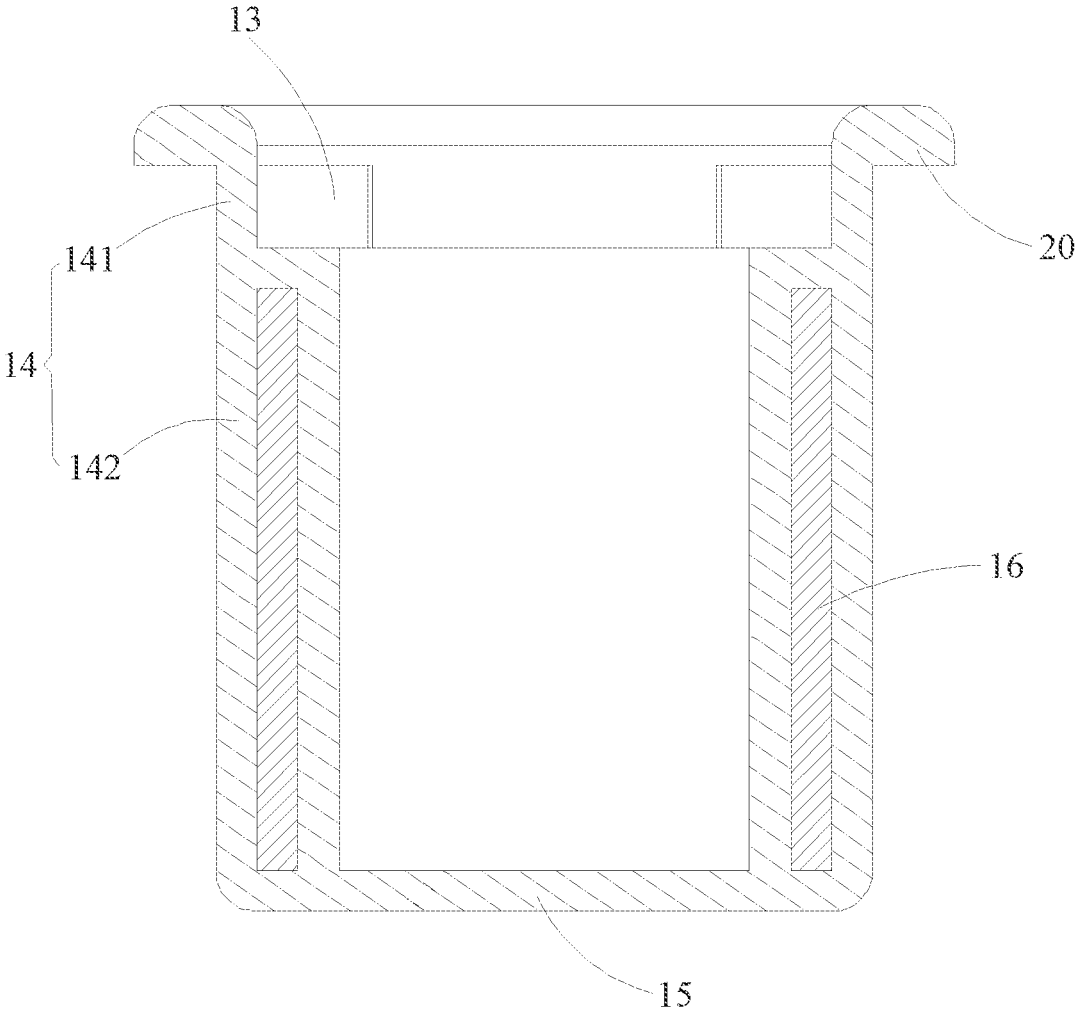
FIG. 15 is a cross-sectional view of an atomization cup according to Example 3 of the disclosure.
Figure 16:
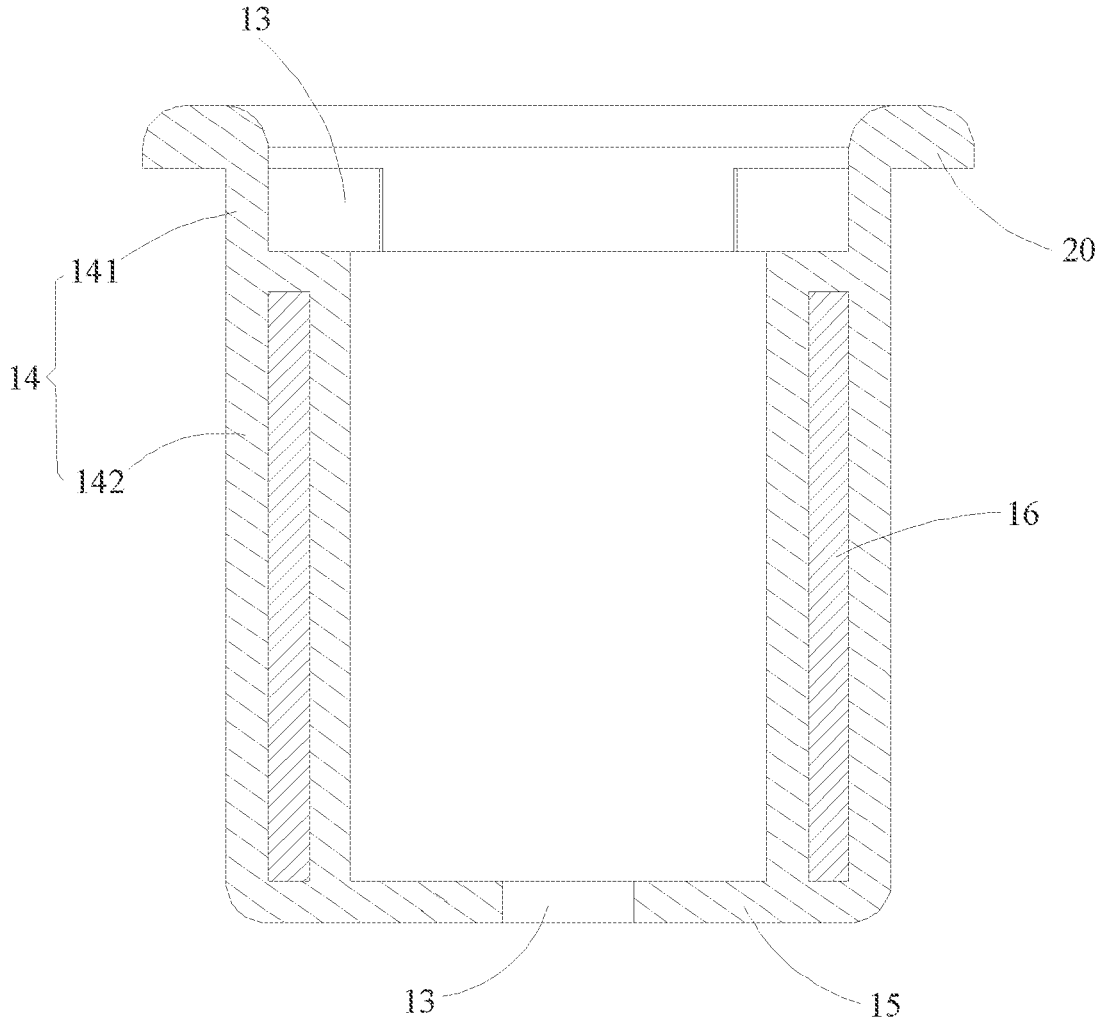
FIG. 16 is a cross-sectional view of an atomization cup according to Example 4 of the disclosure.

Referring to FIGS. 15 and 16, the example is basically the same as Example 3, except for the difference in the position of the through holes 13. In Example 3, the through holes 13 are disposed in the portion of the first surrounding portion 141 where the first flange 20 is not provided. In this Example, the through holes 13 are disposed in the portion of the bottom wall 15 and the first surrounding portion 141 where the first flange 20 is not provided.

It will be obvious to those skilled in the art that changes and modifications may be made, and therefore, the aim in the appended claims is to cover all such changes and modifications.

What is claimed is:

1. An atomization assembly, comprising an atomization cup for heating a tobacco material to produce smoke, and a smoke guiding cup for conveying the smoke from the atomization cup to a smoke filter; wherein:

the atomization cup comprises a cup body, the cup body comprises a first side wall, a first cavity confined by the first side wall, and a through hole;

the first cavity is configured to accommodate the tobacco material;

the through hole is configured to convey the smoke generated by the tobacco material out of the atomization cup into the smoke guiding cup;

the through hole communicates with the first cavity;

the first side wall comprises a heating element made of conductive material, or the first side wall is made of conductive material; and the smoke guiding cup comprises a support part and a connection part, wherein the support part is configured to receive and support the atomization cup, and the support part comprises a second side wall and a second cavity confined by the second side wall; the connection part is connected to the support part, and is configured to be connected to the smoke filter;

the first side wall is disposed in second cavity;

the atomization cup comprises a first flange, the first flange extends circumferentially and radially out from the outer peripheral surface of one end of the first side wall;

the first flange abuts against one end of the second side wall, whereby the atomization cup is supported by and detachable from the smoke guiding cup;

the cup body further comprises an opening; the cup body is configured to receive or remove the tobacco material via the opening; and the opening communicates with the first cavity;

a bottom wall is disposed on the other end of the first side wall and is opposite to the opening; and the first side wall and the bottom wall are connected to each other to confine the first cavity; and the first side wall further comprises a first surrounding portion and a second surrounding portion; the second surrounding portion is connected to the first surrounding portion and the bottom wall; the first flange is disposed on one end of the first surrounding portion away from the second surrounding portion; and the heating element is disposed inside the second surrounding portion.

2. The atomization assembly of claim 1, wherein the atomization cup further comprises a second flange; the first surrounding portion comprises a first surrounding section, a second surrounding section, and a third surrounding section; the second surrounding section is connected to the first surrounding section and the third surrounding section; the first flange protrudes from the outer peripheral surface of the first surrounding section; the third surrounding section is connected to the second surrounding portion; the second flange is disposed on the second surrounding section, and protrudes outward in a circumferential direction of the second surrounding section; an outer diameter of the second flange is smaller than that of the first flange; and the first flange and the second flange form a step.

3. The atomization assembly of claim 1, wherein the through hole is disposed on the bottom wall and/or the first side wall.

4. The atomization assembly of claim 1, wherein the first side wall is in the shape of a cylinder, a three-sided prism, or a square column; and/or the first side wall is integrated with the bottom wall.

5. The atomization assembly of claim 1, wherein the heating element made of the conductive material is configured to generate heat by electrifying or by high frequency magnetic field, and the conductive material is at least one of metal, graphene, semiconductor, superconductor and carbon-containing conductive material; and/or the first side wall comprises an inner surface and an outer surface; the heating element is disposed on the inner surface and/or the outer surface, or disposed inside the first side wall;

the heating element is in a shape of film, layer, net, or wire, and is disposed on the first side wall in at least one manner selected from embedding, coating, printing, cladding, and pasting; and the first side wall comprises glass, agate, quartz, crystal, jade, mica, or ceramic.

6. The atomization assembly of claim 1, wherein the bottom wall comprises the heating element made of conductive material, or the bottom wall is made of conductive material; and/or a protective part is disposed on an inner surface and/or an outer surface of the first side wall, and/or disposed on an inner surface and/or an outer surface of the bottom wall.

7. The atomization assembly of claim 6, wherein the protective part comprises glass, agate, quartz, crystal, jade, mica or ceramic; and/or the conductive material is at least one of metal, graphene, semiconductor, superconductor and carbon-containing conductive material; and/or the heating element is disposed on the inner surface and/or the outer surface of the bottom wall, or disposed inside the bottom wall;

the heating element is in a shape of film, layer, net, or wire, and is disposed on the bottom wall in at least one manner of embedding, coating, printing, cladding and pasting; and the bottom wall comprises glass, agate, quartz, crystal, jade, mica, or ceramic.

8. The atomizer assembly of claim 4, wherein the smoke guiding cup comprises a second channel; the atomization cup is detachably disposed in the smoke guiding cup, and the second channel communicates with the through hole.

9. The atomizer assembly of claim 8, wherein the atomization cup is encompassed by the support part; the support part and the connection part are in the shape of a hollow tube; and the support part and the connection part are connected to each other whereby the second channel is formed.

10. The atomizer assembly of claim 9, wherein the connection part comprises a first connecting section and a second connecting section; the first connecting section is connected to the support part and the second connecting section.

11. An atomization assembly, comprising an atomization cup for heating a tobacco material to produce smoke, and a smoke guiding cup for conveying the smoke from the atomization cup to a smoke filter; wherein:

the atomization cup comprises a cup body, the cup body comprises a first side wall, a first cavity confined by the first side wall, and a through hole;

the first cavity is configured to accommodate the tobacco material;

the through hole is configured to convey the smoke generated by the tobacco material out of the atomization cup into the smoke guiding cup;

the through hole communicates with the first cavity;

the first side wall comprises a heating element made of conductive material, or the first side wall is made of conductive material; and the smoke guiding cup comprises a support part and a connection part, wherein the support part is configured to receive and support the atomization cup, and the support part comprises a second side wall and a second cavity confined by the second side wall; the connection part is connected to the support part, and is configured to be connected to the smoke filter;

the first side wall is disposed in second cavity;

the atomization cup comprises a first flange, the first flange extends circumferentially and radially out from the outer peripheral surface of one end of the first side wall;

the first flange abuts against one end of the second side wall, whereby the atomization cup is supported by and detachable from the smoke guiding cup;

the cup body further comprises an opening; the cup body is configured to receive or remove the tobacco material via the opening; and the opening communicates with the first cavity;

a bottom wall is disposed on the other end of the first side wall and is opposite to the opening; and the first side wall and the bottom wall are connected to each other to confine the first cavity;

the through hole is disposed on the bottom wall; the atomization cup further comprises a guide tube disposed on one side of the bottom wall away from the first cavity; and the guide tube further comprises a first channel connected to the through hole.

12. An atomization assembly, comprising an atomization cup for heating a tobacco material to produce smoke, and a smoke guiding cup for conveying the smoke from the atomization cup to a smoke filter; wherein:

the atomization cup comprises a cup body, the cup body comprises a first side wall, a first cavity confined by the first side wall, and a through hole;

the first cavity is configured to accommodate the tobacco material;

the through hole is configured to convey the smoke generated by the tobacco material out of the atomization cup into the smoke guiding cup;

the through hole communicates with the first cavity;

the first side wall comprises a heating element made of conductive material, or the first side wall is made of conductive material; and the smoke guiding cup comprises a support part and a connection part, wherein the support part is configured to receive and support the atomization cup, and the support part comprises a second side wall and a second cavity confined by the second side wall; the connection part is connected to the support part, and is configured to be connected to the smoke filter;

the first side wall is disposed in second cavity;

the atomization cup comprises a first flange, the first flange extends circumferentially and radially out from the outer peripheral surface of one end of the first side wall;

the first flange abuts against one end of the second side wall, whereby the atomization cup is supported by and detachable from the smoke guiding cup;

the smoke guiding cup comprises a second channel; the atomization cup is detachably disposed in the smoke guiding cup, and the second channel communicates with the through hole;

the atomization cup is encompassed by the support part; the support part and the connection part are in the shape of a hollow tube; and the support part and the connection part are connected to each other whereby the second channel is formed; and an inner diameter of the support part is smaller than an outer diameter of the first flange of the atomization cup and not smaller than an outer diameter of a second flange of the atomization cup; the end of the support part away from the first connecting section is connected to a step.

* * * * *